United States Patent [19]

Verhoeven

[11] Patent Number: 4,715,824

[45] Date of Patent: Dec. 29, 1987

[54] CONNECTOR FOR INTERCONNECTING CABLE TO A PRINTED CIRCUIT BOARD

[75] Inventor: Laurentius M. Verhoeven, Rv Veghel, Netherlands

[73] Assignee: E. I. Du Pont de Nemours and Company, Wilmington, Del.

[21] Appl. No.: 937,500

[22] Filed: Dec. 3, 1986

[30] Foreign Application Priority Data

Dec. 4, 1985 [NL] Netherlands ..... 8503347

[51] Int. Cl.[4] ..... H01R 4/24

[52] U.S. Cl. ..... 439/391; 439/449

[58] Field of Search ..... 439/391, 393, 417, 425, 439/426, 449, 460, 468, 469, 680, 681

[56] References Cited

U.S. PATENT DOCUMENTS

| | | | |
|---|---|---|---|
| 2,937,357 | 5/1960 | Kennedy | 339/17 |
| 3,388,367 | 6/1968 | Brown | 439/417 |
| 3,576,519 | 4/1971 | Janye et al. | 439/681 |
| 4,160,575 | 7/1979 | Schraut | 339/103 |
| 4,307,927 | 12/1981 | Mollman | 439/681 |
| 4,516,822 | 5/1985 | Wolfel | 439/425 |

FOREIGN PATENT DOCUMENTS

| | | |
|---|---|---|
| 0027696 | 3/1980 | European Pat. Off. . |
| 0063696 | 2/1982 | European Pat. Off. . |
| 0178712 | 9/1985 | European Pat. Off. . |
| 2041372 | 4/1969 | France . |
| 160555 | 5/1933 | Switzerland . |

*Primary Examiner*—Joseph H. McGlynn

[57] ABSTRACT

A connector for interconnecting a multiconductor cable and a printed circuit board. The connector includes means for receiving and contacting individual conductors at one end of the conductor housing. It also includes at the other end means for plugging the connector onto a printed circuit board so that electrical contact is made between the conductors of the cable and contact strips on the printed circuit board.

6 Claims, 12 Drawing Figures

3
1
5
8
9
7
10,1
10,3
16
6
19
19
4
15
10
28
10,2
13

12
27
27
26

CONNECTOR FOR INTERCONNECTING CABLE TO A PRINTED CIRCUIT BOARD

BACKGROUND OF THE INVENTION

1. Field of the Invention

This invention relates to a connector for a multiconductor cable with a number of separate insulated conductors and, more particularly, to making connection to a corresponding number of parallel contact strips near the edge of an electrical circuit such as a circuit board.

2. Description of Related Art

Connectors for interconnecting a multiconductor cable and a printed circuit board typically have a block-shaped insulation with a section for receiving the cable conductors at one end. One such connector is disclosed in European Patent Application No. 0 063 696 published Nov. 3, 1982. The other end of the housing is formed as U-shaped jaw and can be plugged onto the edge of a printed circuit board.

In the connector described in the aforenoted European Patent Application, the long block-shaped insulation housing is provided in the longitudinal direction on the top and bottom sides with receiving grooves for receiving in each case the contact springs. At the plug-on side, the spring parts of the contact springs are then situated alternatingly on either side of the U-shaped jaw. In this manner, in light-current engineering such as in telephone sets, the end of a multiconductor cable can be connected to a printed circuit board which is provided with contact strips on both sides near the edge. In the aforenoted connector, the contact springs are situated in wide receiving grooves so that the flat spring part can make contact over a wide surface area with the respective contact strip in a plane parallel to the printed circuit board which is to be contacted. The anchorable part of the contact spring situated in the conductor section of the insulation housing has a piece which is bent at approximately a right angle to the flat mainpart of the spring and which has two teeth which can be pierced through the insulation of and through the associated conductor. The conductors are alternately connected to the contact springs at top and bottom sides of the insulation housing. The insulation housing and specifically its conductor section are rigidly and solidly constructed. The conductor insertion openings are small channels which run through the solid part of the insulation housing. The wide receiving grooves at the top and bottom sides of the insulation housing penetrate only to a small depth into the material of the solid insulation housing.

SUMMARY OF THE INVENTION

The object of the present invention is to provide a very small slim connector which easily electrically contacts the contact strips on one side of a printed circuit board in an expediently safe manner. The object of the invention is also to construct the contact springs of the connector so that they can be pressed easily in a single process out of a flat spring without supplementary bending operations.

The present invention achieves these objects by dividing the insulation housing in the longitudinal direction into narrow chambers, which are each aligned with conductor-receiving channels and contact spring receiving grooves, by partitions running from one side to the other of the connector housing. All the receiving grooves are disposed at the one side of the insulation housing and in each case merge into the narrow chambers. Each contact spring is constructed in its entirety as a flat spring to be inserted in the plane of its respective narrow chamber. Each contact spring also includes a spring part at the plug-on section end which is U-shaped. One leg of the U-shaped end is designed for contacting the respective contact strip on one side of the printed circuit board. The other leg of the U-shaped end of the contact spring is designed for contactless support in the plug-on section. There is also an anchorable part in line with the other leg in the conductor section which includes in the same plane at least one tooth.

The printed circuit board to be contacted is provided near its edge with contact strips on one or on both sides. The connector according to the invention with contact springs constructed as described above will contact (according to the plugging-on requirements) with the contact strips on one or other side of the printed circuit board.

An advantageous embodiment of the invention is characterized in that each groove at one side of the housing has a rib near the conductor insertion end such that after inserting and locating each prepositined contact spring, the latter may be anchored with a notch on the contact spring.

Furthermore, in an embodiment of the invention, at the position of a contact spring in its respective narrow chamber, a small polarisation or positioning plate can be inserted into the U-shaped jaw from the plug-on side. The plate is made of insulation material and fits into a slot in the printed circuit board formed at a position of the corresponding contact strip in order to achieve the desired positioning of the connector.

Furthermore, transverse to the longitudinal direction at one side in the conductor receiving section, a comb-like part or a row of separate comb parts of the insulation housing is constructed with teeth separated at the desired conductor pitch spacing and directed towards the conductors. The comb-like part or separate comb parts are slidable inwards for maintaining the conductors spaced and for clamping them. These comb-like parts are injection-moulded during the manufacture as a component of the insulation housing. When the conductors are inserted, exerting pressure force the comb-like part (or each separate comb part of the row) will cause it to break free and be pressed inwards until the teeth are situated between the conductors.

BRIEF DESCRIPTION OF THE DRAWINGS

The invention may be better understood by reference to the following detailed description when considered in conjunction with the accompanying drawings, in which.

DETAILED DESCRIPTION OF THE INVENTION

Figure 1:
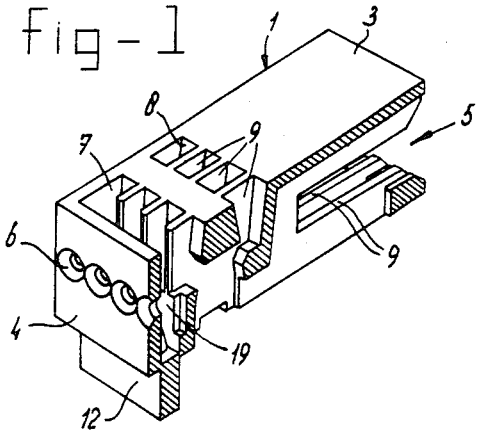
FIGS. 1 to 4 are perspective views of a connector according to the invention, partially cut-away in the longitudinal direction, in various stages of assembly of the insulation housing and the associated conductors and contact springs.

As shown in FIGS. 1–5, the connector includes a generally block-shaped insulation housing 1 having bottom and top surfaces 2 and 3, a cable conductor insertion end 4, and plug-on end 5. The housing also includes a number of partitions 9 extending parallel to the housing's longitudinal direction. The partitions 9 divide the connector housing into a number of narrow chambers with conductor receiving channels at one end of the housing and contact spring grooves 14 at the other end.

The conductor insertion end 4 has a number of openings 6 through which conductors 11 of a multiconductor cable can be inserted into conductor receiving channels 7 until their ends abut against wall 8. The wall 8 essentially divides the conductor housing into two sections. The first section includes the conductor insertion end 4 and the second section includes the plug-on end 5. The latter has a U-shaped jaw projecting from end 5 of the connector. The openings 6 may be rectangular or any other suitable shape. FIG. 1 shows the connector partially cut away prior to insertion of conductors 11 and/or contact springs 10.

The connector of FIG. 1 also includes a comb-like part 12 which is formed as part of the injection-molded insulation housing 1. As can be more clearly seen in FIGS. 3 and 4, the comb-like part 12 is provided with separate conical teeth 13, separated at the pitch spacing of the conductors. The function of these teeth will be explained below.

Figure 3:
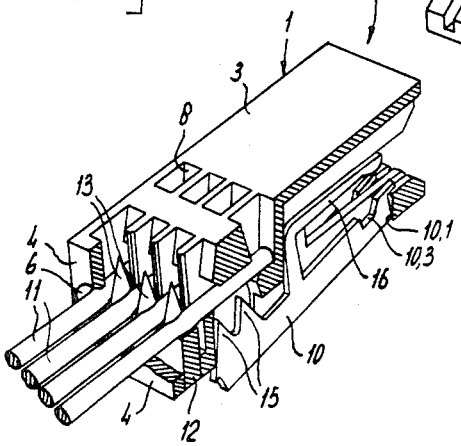
Figures 2A, 2B:
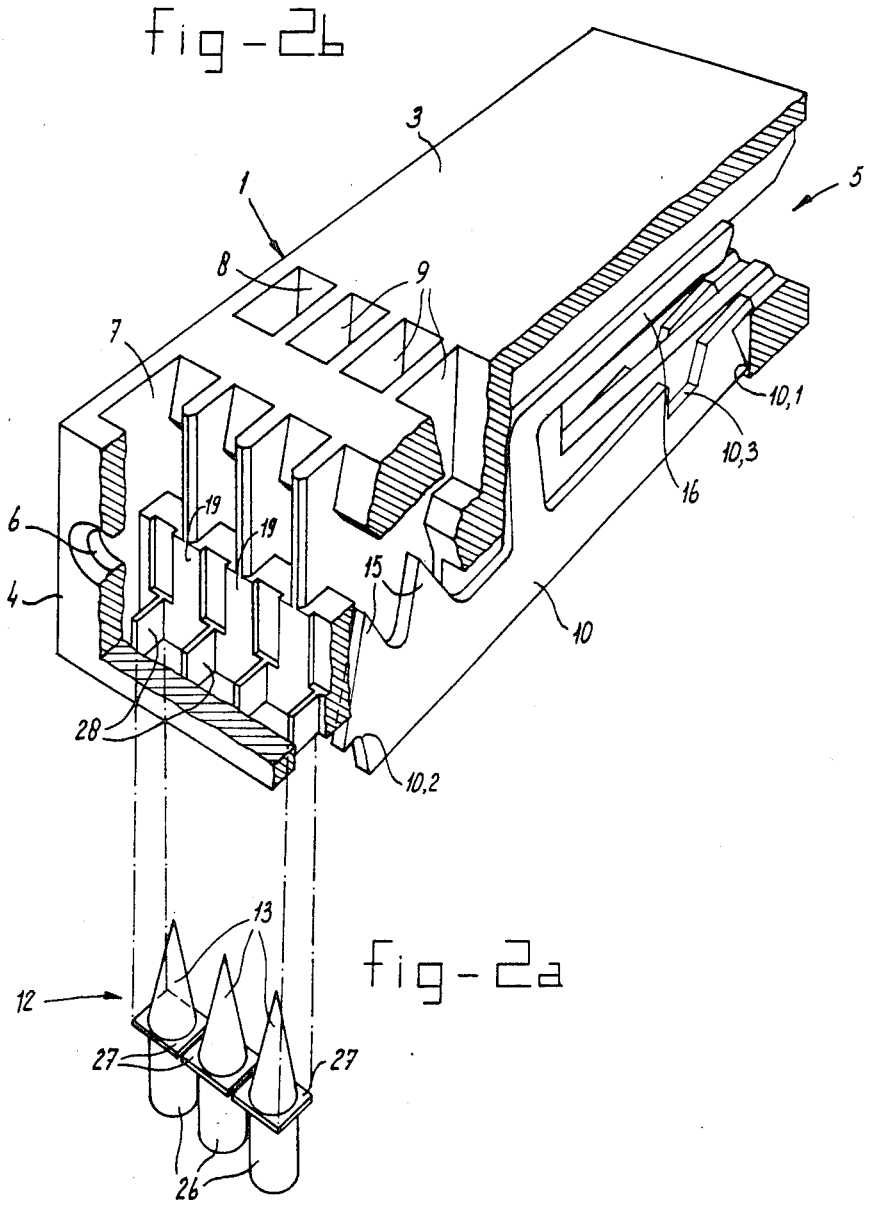

FIG. 3 shows the comb-like part 12 as comprising a single block with teeth 13 projecting towards the interior of the insulation housing 1. On the side facing the connector, the comb-like part 12 is joined via its edges to the bottom side 2 of the insulation housing 1. FIG. 2*a* shows the comb-like part 12 as separate comb elements. Each comb element is formed from a cylinder 26, a small plate 27 and a tooth 13. The comb elements are each secured via the small plate 27 to the bottom side 2 of the insulation housing 1. In FIG. 2*b*, it can also be seen that between the outside wall of the conductor insertion end 4 and an inner transverse wall 19, there are disposed small partitions 28 for strengthing the housing construction. These small partitions 28 may extend from the bottom side 2 up to a plane extending just below the insertion opening 6.

FIGS. 2*b* and 3 illustrate, furthermore, the manner in which a contact spring 10 is partially inserted or prepositioned in its respective groove 14. The contact spring 10 may be slid into a receiving groove 14 from the bottom side 2 starting from the U-shaped, plug-on end 5. Each contact spring 10 is constructed in its entirety from a flat spring with all parts disposed in one plane, which requires very little room and can be inserted in the plane of a receiving groove 14 and corresponding narrow chamber. Each contact spring 10 has a long, continuous leg which, together with another spring leg 16 forms a U-shaped spring part at the plug-on end 5. Said spring leg 16 may be provided with a contact curvature. The contact spring 10 has at least one, but generally two, teeth 15 at the other end of the continuous leg in the region of the conductor insertion end. The function of these teeth will be explained below. Furthermore, the continuous leg has a recess 10.3 in the region of the plug-on section. Said recess engages a projection in the top side 3 of the housing when the contact spring 10 is inserted.

FIG. 3 illustrates the manner in which the conductors 11 are inserted through the openings 6 and disposed in one plane in the conductor receiving channels until their ends abut against the wall 8. Thereafter, the comb-like part 12, which at this point is still projecting outside the insulation housing 1 in FIG. 1, can be broken free from the insulation housing by pressure force by the user and slid inward into the space available therefor over the width of the insulation housing. In the embodiment of FIGS. 2*a* and 2*b* each comb element is pressed free separately by the user and slid inward along and between the small partitions 28 between the walls 4 and 19. The conical teeth 13 are each separated at the required pitch spacing and have such a conical shape so that when either the comb-like part 12 of FIG. 3 or the separate comb elements of FIG. 2*b* are pressed inward, the teeth 13 end up between and separate the conductors from each other while simultaneously clamping them in the inserted state, as shown in FIG. 3. As a result, both good positioning of the separate insulated conductors and a pull or strain relief are obtained. The length of the teeth 13 and their conical form are chosen in a manner such that account is taken of the penetration of the insulation. The clamped position of the comb-like part 12 in the space in the insulation housing cut out for that purpose prevents the part 12 from coming out again. Furthermore, as can also be seen in FIG. 3, the partially inserted and prepositioned contact spring 10, with their teeth 15 now end up directly opposite each insulated conductor 11.

Figure 4:
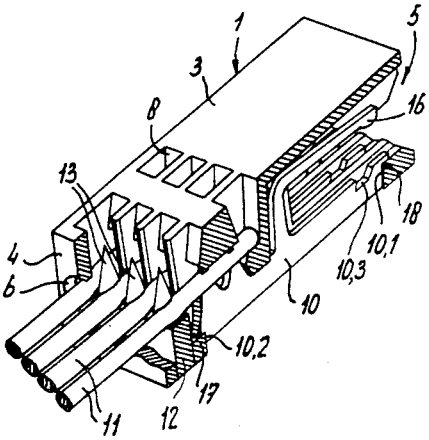

The flat contact spring 10 can now, as shown in FIG. 4, be pressed inward so that the teeth 15 penetrate through the insulation and pierce into or through each conductor, thereby making electrical contact. FIG. 4 shows the points of the teeth 15 penetrated into the conductor and through its insulation. The contact spring 10 also has a notch 10.1 in the long, continuous leg which facilitates location in the plug-on end of the connector. In conjunction with a corresponding rib 18 formed in the insulation housing, the notch 10.1 permits the contact to pivot during sliding in. There is another notch 10.2. This notch interacts with a corresponding rib 17 in the insulation housing. When the teeth 15 are pressed into the conductor in the last phase of the location, the notch 10.2 will at the same time end up anchored on the corresponding rib 17. As a result, the contact spring 10 is reliably clamped, and an electrical through-contact to the conductor 11 is obtained.

Figure 5:
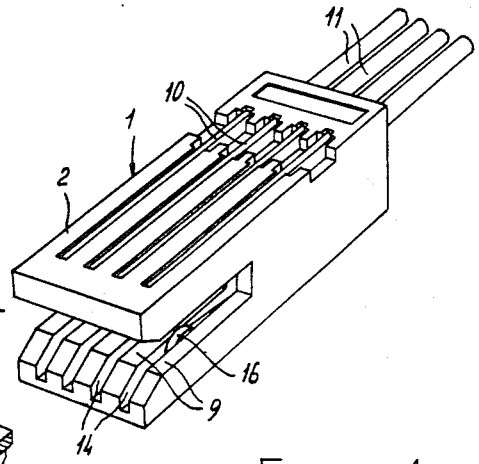
FIG. 5 is a perspective view of the other side of an assembled connector according to the invention.

FIG. 5 is a perspective view opposite to that of FIG. 1 wherein the bottom side 2 and the plug-on end 5 of the connector are better seen. All the receiving grooves 14 are provided with a separate contact spring 10. As shown in FIG. 5, the spring leg 16 of a contact spring is still visible on the right-hand side in its corresponding groove 14. This leg 16 makes contact with a corresponding contact strip on the edge of a printed circuit board.

Figure 6:
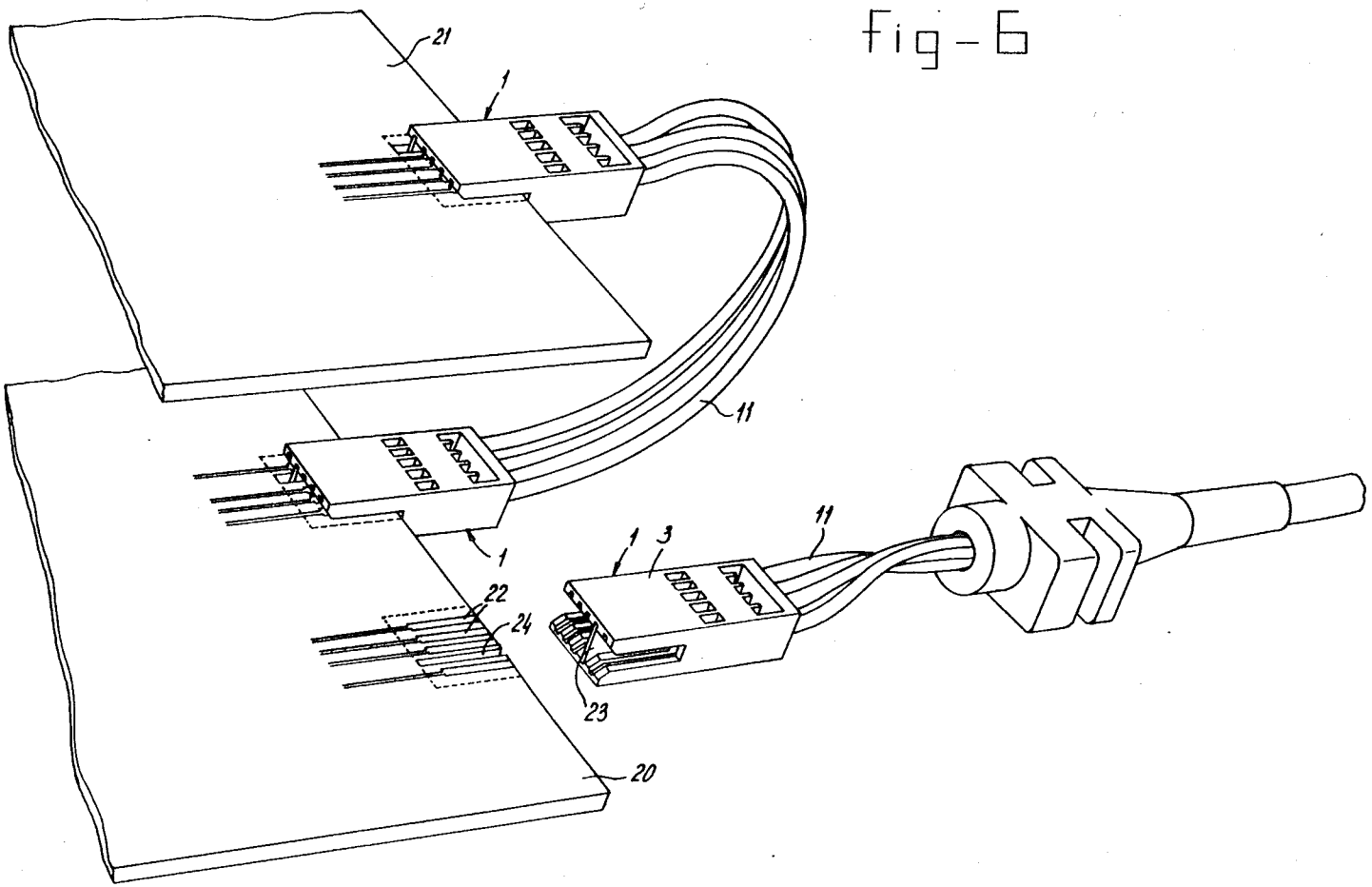
FIG. 6 is a perspective illustration of the manner in which three connectors according to the invention provided with a polarization or positioning clip can be connected to a printed circuit board; and FIGS. *7a* to *7e* are perspective views of a connector with an auxiliary piece for contacting a plurality of contact pins of a pinholder.
Figure 7A:
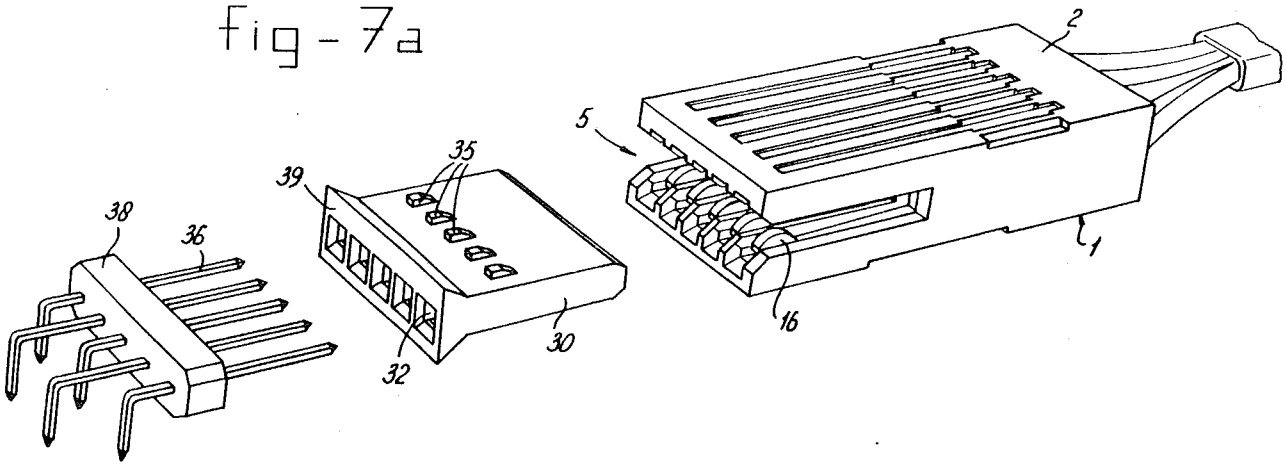
Figure 7D:
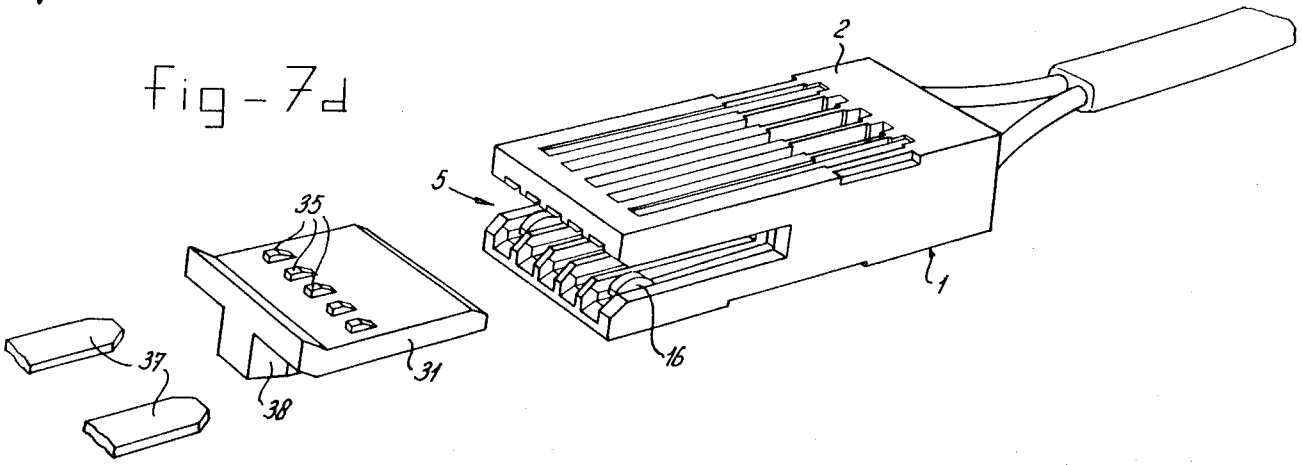
Figure 7B:
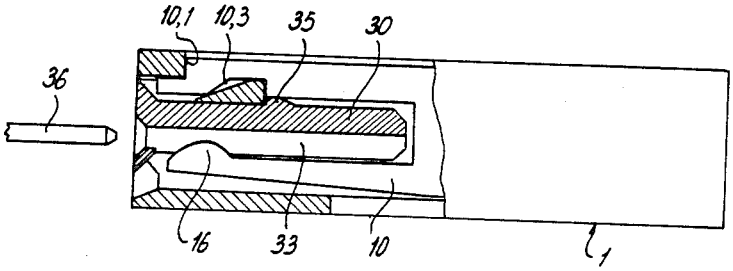
Figure 7C:
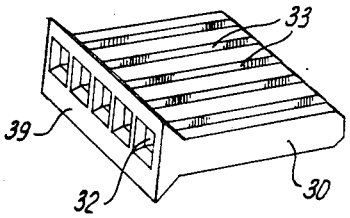
Figure 7E:
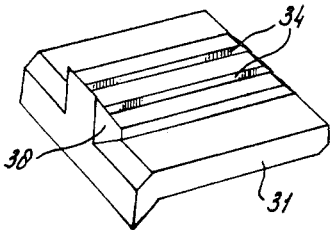

Finally, FIG. 6 illustrates the manner in which both a round and a flat cable, each consisting of a number of separate conductors, can be respectively connected via the connector of the present invention to printed circuit boards 20 and 21. A number of contact strips 22 are applied in parallel by conventional techniques to either one or both sides of the printed circuit boards. The connectors are all shown with the top side 3 facing upwards. The comb-like section 12 has in this case been omitted in the drawing for the sake of simplicity. In this position of the connectors, the spring legs 16 of the contact springs 10 make contact with the respective contact strips 22 on the printed circuit boards. These contact strips 22 merge into the printed circuit.

There can also be incorporated in one of the receiving grooves 14 of the connector an insulation plate, referred to as a polarization of positioning clip 23, which interacts with a corresponding groove 24 in the edge of the printed circuit board. Such a polarization or positioning clip prevents the connector from being plugged onto the printed circuit board or card incorrectly whereby contact is not achieved between the correct contact strips and the corresponding legs 16 of the contct springs. It should be understood that the clip and corresponding groove must not be disposed in the center of the corresponding contact plane but in an asymmetric manner.

FIGS. *7a* through *7e* show perspective views of an auxiliary insulation piece in two embodiments for receiving two or more contact pins of a pinholder. Said pins have a square, round or flat cross-section as required. Said auxiliary piece is inserted in said connector, by which such a edge card connector in a simple manner is converted in a plug-on pinconnector. These pins generally are fixed in a pinholder. In order to overcome the small pitch spacing between these pins at one side of the pinholder use could be made of a staggered implementation (FIG. *7a*) for a further connection to a printed circuit board or the like.

FIG. *7a* gives a perspective view how a connector 1 can be connected via an auxiliary piece 30 of insulating material to a plurality of pins 36 having a square cross-section and fixed in a pinholder. The auxiliary piece 30 comprises a tulip-shaped insertion end 39 which corresponds with the tulip-shaped end 5 of the plug-on section of the connector 1. Said insertion end 39 includes openings 32 for the pins 36 which have to be inserted and which have to make contact with the spring legs 16 of the contact springs 10. FIG. *7d* gives a perspective view of another embodiment of such an auxiliary piece 31. In this case the connector 1 has to be connected to two flat pins 37 which via the auxiliary piece 31 engage the spring legs 16 of two contact springs 10. The auxiliary pieces 30, 31 on the one wide side are provided with guiding cams 35 which, upon insertion of said auxiliary piece into the plug-on section of the connector 1, glide in the corresponding grooves 14. FIG. *7b* gives a cross-section view of a connector together with inserted auxiliary piece 30. The said guiding cam 35 is locked behind a projection of the housing which is intended to engage the notch 10.3 of the spring 10.

FIGS. *7c* and *7e* respectively give a view of the other wide side of the auxiliary pieces 30, 31. FIG. *7c* shows the open guiding channels 33 which serve to guide the pins which have to be inserted. FIG. *7e* shows the slots 34 which serve to guide the projection 38 of the auxiliary piece 31 on the two corresponding walls between the grooves 14 in the connector 1. The flat pins 37 glide at either side of this projection over the spring legs 16 of two contact springs 10.

It should be also understood that the forms of the invention shown and described herein are but preferred embodiments and that various changes may be made without departing from the spirit and scope of the invention.

I claim:

1. A connector for interconnecting a multiconductor cable having a plurality of conductors, each surrounded by insulation material, with a printed circuit board comprising:

a block-shaped insulation housing having a first section for receiving the conductors of the cable at one end, and a second section terminating in the form of a U-shape at the other end of the housing capable of being connected to the printed circuit board, a plurality of partitions aligned longitudinally along said connector housing, said partitions defining in said one section a plurality of conductor receiving channels and in said second section a plurality of parallel grooves, a plurality of openings at said one end of the housing and aligned with said channels so that the conductors are individually inserted and received within the channels of said first housing section, a plurality of long, flat contact springs adapted for insertion in each of the parallel grooves, each said contact psring having at the end to be inserted in the first housing section at least one tooth capable of piercing through the insulation material of and making electrical contact with the conductor received in the channel which is aligned with the groove in which said contact spring is inserted, the other end of each said contact spring being adjacent said other end of the housing and terminating in a U-shaped spring part with a first and second leg, said first leg designed for electrically contacting a corresponding contact strip on the printed circuit board, said first and second legs and said one tooth being disposed in approximately the same plane as the rest of the contact spring.

2. A connector according to claim 1 wherein each groove has a rib near the conductor insertion end which corresponds with a notch formed in each contact spring for securing said contact spring within the groove.

3. A connector according to claim 1, further comprising a positioning clip disposed at the U-shaped other end of the housing, said clip adapted to fit into a slot in the printed circuit board in such a manner so as to prevent improper connection to the printed circuit board.

4. A connector according to claim 1 wherein the insulating housing further includes a comb-like part formed at said one end of the first housing section, said part having comb-like teeth separated at the corresponding conductor pitch spacing, said comb-like part being slidable inward for maintaining the conductors received within the connector properly spaced and clamped.

5. A connector according to claim 4 wherein the comb-like part comprises a number of separate comb elements, each including a cylindrical part, a small plate, and a comb-like tooth.

6. A connector according to claim 4 wherein the comb-like part is formed as part of the insulation housing whereby after the conductors are inserted into the housing, the comb-like part can be broken free by exerting pressure and pressed inwardly until the teeth end up between the conductors.

* * * * *